US008615182B2

(12) United States Patent
Ikeda

(10) Patent No.: US 8,615,182 B2
(45) Date of Patent: Dec. 24, 2013

(54) PRINTING SYSTEM, CONTROL METHOD OF THE PRINTING SYSTEM, AND PROGRAM FOR EXECUTING THE CONTROL METHOD

(75) Inventor: Sanae Ikeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 13/332,141

(22) Filed: Dec. 20, 2011

(65) Prior Publication Data

US 2012/0163853 A1 Jun. 28, 2012

(30) Foreign Application Priority Data

Dec. 27, 2010 (JP) ..... 2010-290330

(51) Int. Cl.
*G03G 15/00* (2006.01)

(52) U.S. Cl.
USPC ..... 399/82

(58) Field of Classification Search
USPC ..... 399/82, 394
See application file for complete search history.

(56) References Cited

U.S. PATENT DOCUMENTS

| | | | | |
|---|---|---|---|---|
| 8,303,071 | B2 * | 11/2012 | Eun | 347/16 |
| 2010/0027040 | A1 * | 2/2010 | Kuroda | 358/1.9 |
| 2010/0196027 | A1 * | 8/2010 | Strossman et al. | 399/45 |

FOREIGN PATENT DOCUMENTS

JP 2008-145595 A 6/2008

OTHER PUBLICATIONS

Translation of JP, 2008-145595, A listed in IDS pub date: Jun. 26, 2008.*

* cited by examiner

*Primary Examiner* — Walter L Lindsay, Jr.
*Assistant Examiner* — Frederick Wenderoth
(74) *Attorney, Agent, or Firm* — Canon U.S.A., Inc., IP Division

(57) ABSTRACT

A printing system includes a determination unit configured to determine whether input image data includes first data to be printed with the first recording agent and second data to be printed with the second recording agent, and whether the input data inhibits misregistration in a printing position between the first data and the second data on the printing paper, a first printing unit configured to, when the determination unit determines that the input image data inhibits the misregistration in the printing position, transfer and fix the data using the first recording agent and the second recording agent, and a second printing unit configured to, when the determination unit does not determine that the input image data inhibits the misregistration, after transferring and fixing the first data by using the first recording agent, to transfer and fix again the second data by using the second recording agent.

13 Claims, 9 Drawing Sheets

PRINTING SYSTEM, CONTROL METHOD OF THE PRINTING SYSTEM, AND PROGRAM FOR EXECUTING THE CONTROL METHOD

BACKGROUND OF THE INVENTION

1. Field of the Invention

The present invention relates to a printing system in which plural printing apparatuses are connected to each other to execute printing in cooperation therewith to print out data.

2. Description of the Related Art

Recently, there has been proposed an image processing apparatus configured to print using transparent toner (clear toner), which is a kind of special recording agents.

The whole surface coat method which prints the whole printable area of a printing paper with clear toner can provide the whole paper surface with glossiness like a photograph by printing the whole surface of the paper with the clear toner after printing with color toner like CMYK toner.

The partial surface coat method of printing a specified section of the printable area of the printing paper with the clear toner can provide a printed paper partially with glossiness or a decorative effect by printing the paper with the clear toner after printing with the color toner.

Printing with the clear toner enables a variety of expressions by adding a value to an output print.

To execute printing with the clear toner, a system for transferring color toner like the CMYK toner and the clear toner onto a printing paper and fixing the color toner image and the clear toner image on the printing paper at a time is built into an image processing apparatus. Using this image processing apparatus, printing using the clear toner is executed.

However, a problem occurs when adding a configuration for printing with the clear toner. For example, a problem about a loading amount of the toner occurs. More specifically, the image processing apparatus has a limitation (restriction on the total loading amount) of a toner amount which can be fixed in a unit area of the printing paper by a single fixing action. Thus, in an area where a large amount of the CMYK toner is used, no sufficient amount of the clear toner can be used because the total toner amount within the loadable amount is restricted.

To solve this problem, Japanese Patent Application Laid-Open No. 2008-145595 discusses an image processing system combining an image processing apparatus for printing with the color toner, and another image processing apparatus for printing with the clear toner, which are connected to each other to produce a print output with the clear toner. For example, for a user who wants to use the clear toner, an image processing system including an image processing apparatus (apparatus on the former stage) is proposed which executes transferring and fixing of an image with the color toner and another image processing apparatus (apparatus on the latter stage) which executes transferring and fixing of the image with the clear toner, which are connected to each other. In such a configuration, both the CMYK toner and the clear toner can be sufficiently used in a printing target.

In this printing system, an output product from the apparatus on the former stage (hereinafter referred to as former stage apparatus) is input to the apparatus on the latter stage (hereinafter referred to as latter stage apparatus) just as it is. At this time, it is ideal that no misregistration occurs in plane when the both images are printed on an identical paper. However, there is a high possibility that the misregistration in plane may occur on the identical paper because the two printing apparatuses are used.

More specifically, as compared to a case of forming an image with a single conventional printing apparatus, the misregistration is conspicuous in an image output by such plural printing apparatuses connected to each other. For example, when printing with a printing system including the apparatus for printing with the CMYK toner on the former stage and the anther apparatus for printing with the clear toner on the latter stage, which are connected to each other, sometimes the misregistration may be highly noticeable between the color image printed with the CMYK toner and the clear image printed with the clear toner.

Further, another problem is that it is difficult to correct the misregistration compared with a conventional printing apparatus. Although, in the case of a single printing apparatus, the misregistration can be automatically corrected by equipping the printing apparatus with an internal sensor or the like, the misregistration which occurs between separate printing apparatuses cannot be corrected using the internal sensors provided in each apparatus.

Additionally, the misregistration occurs each time when a combination of the former stage apparatus and the latter stage apparatus is changed. Thus, the frequency of correcting the misregistration increases. Yet still another problem is that if existing printing apparatuses are connected to each other to configure this system, it is difficult to add later a means for correcting the misregistration like a sensor to the existing apparatus. Further, from technical viewpoints, it is difficult to avoid the misregistration in printing position between two printing apparatuses completely. As a result, it is possible that the misregistration may be left on the identical printing paper even if the correction is carried out using some means. Despite the above-stated problems, sometimes, alignment between the color image and the clear image is not necessary depending on use application of a final output product or a decorative effect with the clear toner which a user expects. For example, in a case of the "whole surface clear coating" where the whole printable area of a printing paper on which color images are printed is coated with the clear toner, the visual effect of the printed image is little influenced even if some extent of misregistration exists.

Further, in the case of using two printing apparatuses connected to each other, if the latter stage apparatus internally contains a structure for printing the color toner, the latter stage apparatus can execute a printing procedure alone. Thus, if the two printing apparatuses are connected to each other but do not need to be used at the same time to achieve a printing procedure depending on a given printing procedure condition, an operation mode of executing that procedure with only the latter stage apparatus is conceivable. Such a case occurs where a high gloss as a visual effect is not desired, so that a large amount of the clear toner is not applied, where there are few places on which the clear toner needs to be applied, where there are few overlaps between the color image portion and the clear image portion or where no high quality is demanded. In such a case, by printing the color image and the clear image with only the latter stage apparatus, the misregistration, which may occur when using two printing apparatuses connected to each other, can be avoided.

SUMMARY OF THE INVENTION

The present invention is directed to providing a printing system which determines whether misregistration can be tolerated, depending on an application purpose of a final printing product, a decorative effect of the clear toner which a user expects or a processing condition of the printing system, and selects a printing apparatus for use in actual printing.

According to an aspect of the present invention, a printing system includes a first printing apparatus using a first recording agent and a second printing apparatus using a second recording agent and the first recording agent, in which a paper discharge unit of the first printing apparatus is connected to a paper feeding unit of the second printing apparatus. The printing system further includes a determination unit configured to determine whether input image data has first data to be printed with the first recording agent and second data to be printed with the second recording agent, and whether the input image data inhibits misregistration in a printing position between the first data on a printing paper and the second data on the printing paper, a first printing unit configured to, when the determination unit determines that the input image data inhibits the misregistration in a printing position, print the first data and the second data using the first recording agent and the second recording agent by fixing and transferring the data in the second printing apparatus, and a second printing unit configured to, when the determination unit does not determine that the input image data inhibits the misregistration in a printing position, after the first printing apparatus feeds the paper onto which the first data is transferred and fixed with the first recording agent to the second printing apparatus, transfer and fix again the second data using the second recording agent in the second printing apparatus.

Consequently, the present invention can provide a printing system which determines whether the misregistration can be tolerated depending on use application of a final output product, a decorative effect which a user expects and a processing condition of the printing system, and select a printing apparatus to be used in actual printing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, the embodiments for carrying out the present invention will be described with reference to the accompanying drawings. The present exemplary embodiment is directed to a determination method for determining whether to employ a printing apparatus using color toner as a first recording agent and whether to employ a printing apparatus using transparent toner as a second recording agent.

This system joins together a first printing apparatus (regular printing apparatus) configured to print with color toner, as a printing apparatus located on the former stage, and a second printing apparatus (clear toner printing apparatus) configured to print with both clear toner and color toner as a printing apparatus located on the latter stage.

Figure 1:
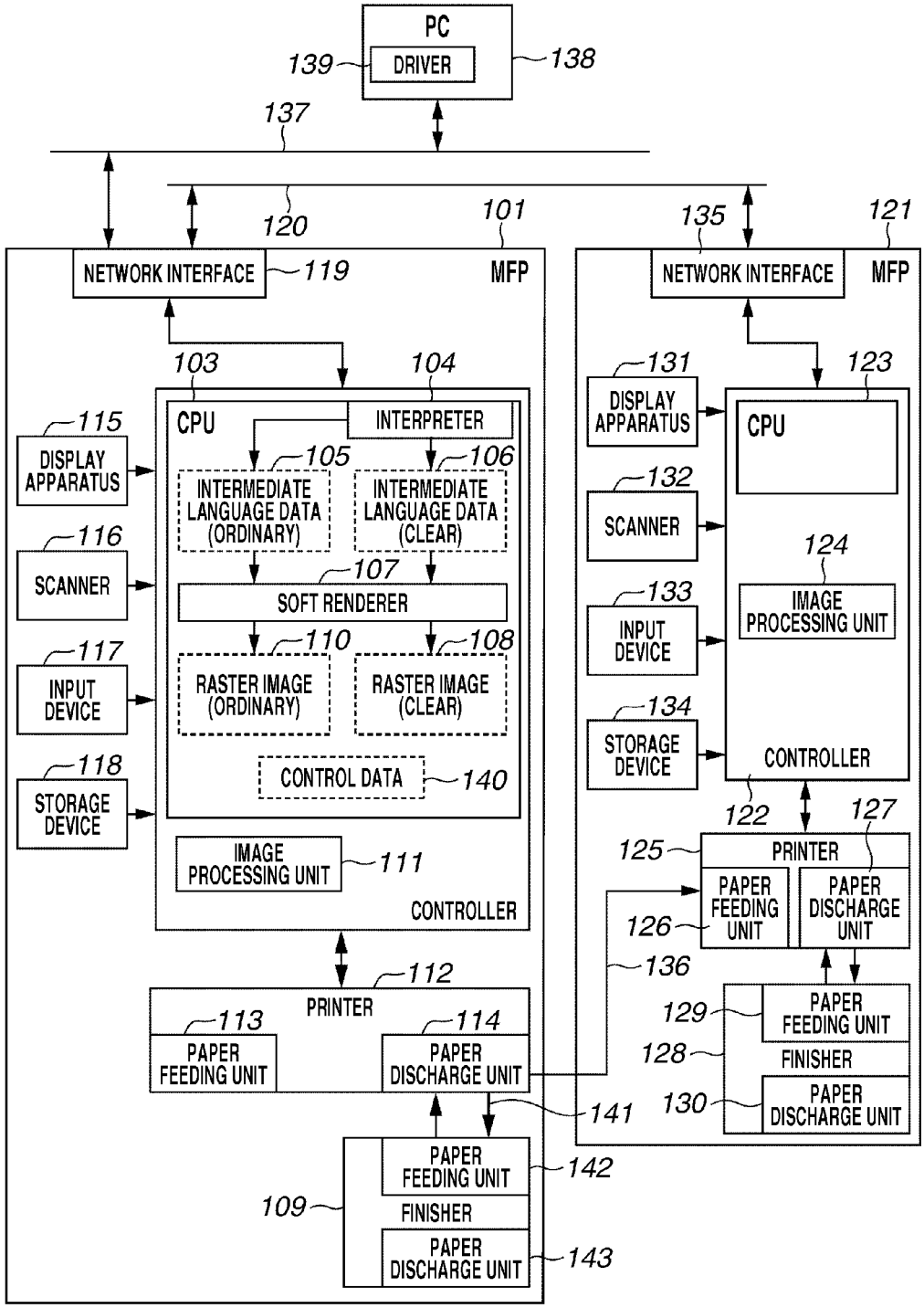
FIG. 1 is a diagram illustrating the configuration of a system according to the present invention.

FIG. 1 is a diagram illustrating the configuration of a system according to this exemplary embodiment. A multifunctional peripheral (MFP) 101 as the first printing apparatus and an MFP 121 as the second printing apparatus are connected via a network 120.

Figure 8:
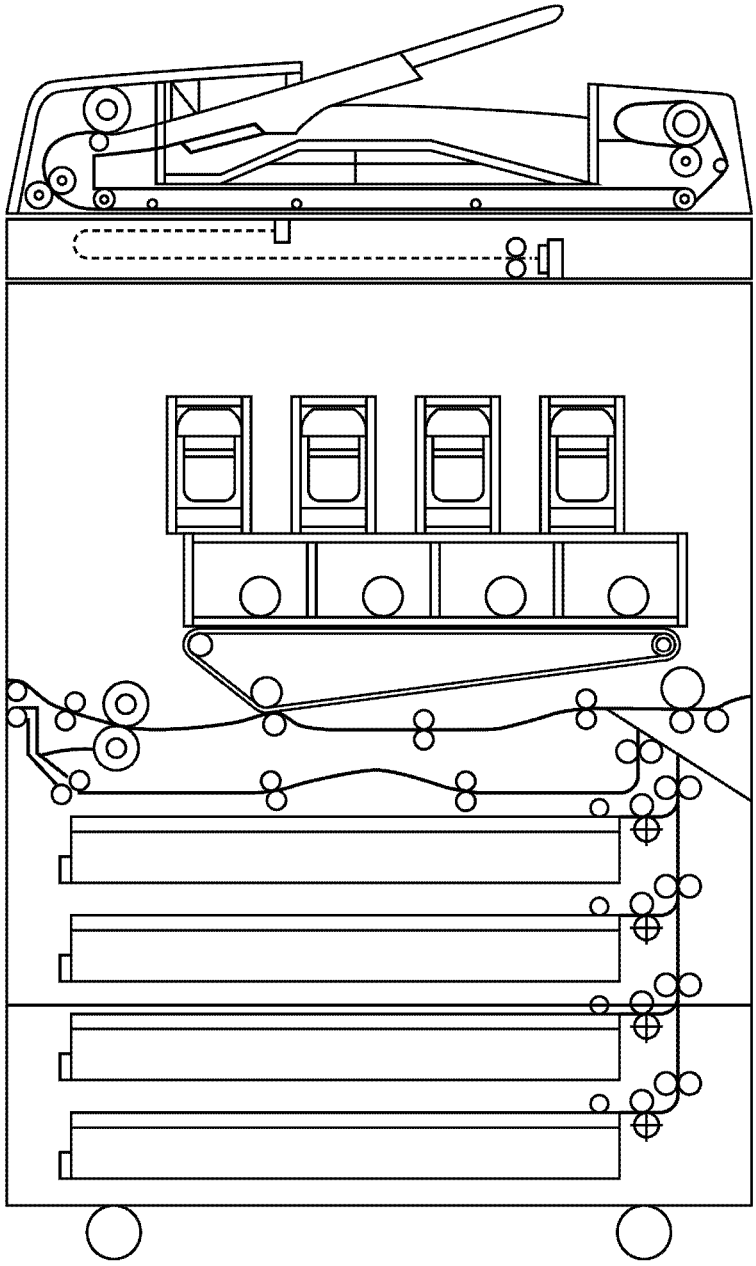
FIG. 8 is a configuration diagram of a printing apparatus having four photosensitive drums.

The first MFP 101 makes prints using the first recording agent. As the first recording agent, color toners which include cyan, magenta, yellow and black (CMYK), and K toner (monochrome toner) can be switched over to each other. In the MFP 101, its printer 112 includes four photosensitive drums and development units for CMYK as illustrated in FIG. 8. Thus, printing with the color toner and printing with the monochrome toner can be executed at a substantially the same velocity.

Likewise, the second MFP 121 makes prints using the clear toner as the second recording agent. Instead of the clear toner, special toners such as light color toner and green toner and other transparent recording agents such as transparent ink may be used. The clear toner is a transparent recording agent capable of generating a transparent image. Using the clear toner, expression can be achieved with glossiness different from a print made with only the color toners.

Figure 9:
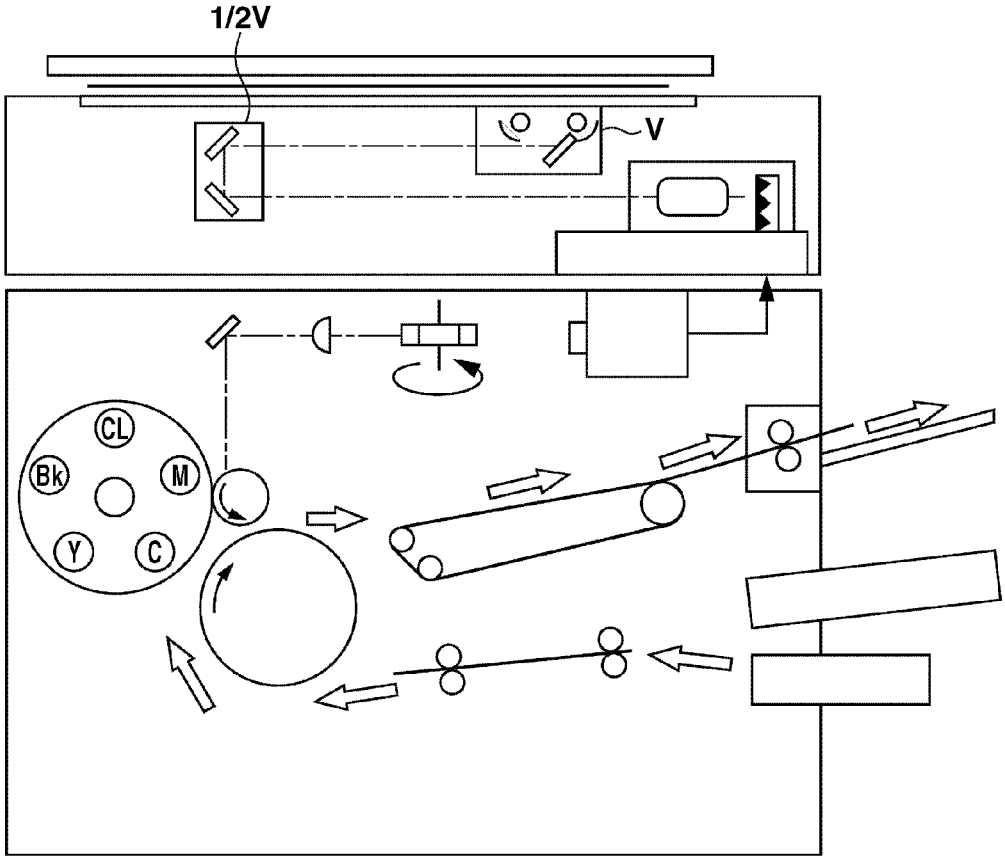
FIG. 9 is a configuration diagram of a printing apparatus having a photosensitive drum.

The recording agent for use here may be switched over among the clear toner, the clear toner with the CMYK color toners, the clear toner with the K toner (monochrome toner), and the CMYK color toners, and the K toner (monochrome toner) only. In the MFP 121, as illustrated in FIG. 9, its printer 125 includes a photosensitive drum and development units for the clear toner and the CMYK color toners, and its productivity changes depending on the number of colors to be added. When printing with only the clear toner or only K toner (monochrome toner), the printing is carried out with a single color and the productivity is equal to or substantially equal to the MFP 101. When printing is carried out with the clear toner and the K toner (monochrome toner), the printing is made with two colors and its productivity is substantially half the MFP 101. When printing is carried out with the CMYK color toners, the printing is made with four colors and its productivity is substantially ¼ of the MFP 101. When printing is carried out with the clear toner and the CMYK color toners, the printing is made with five colors and its productivity is substantially ⅕ of the MFP 101.

A paper discharge unit 114 of the printer 112 inside the first MFP 101 and a paper feeding unit 126 of the printer 125 inside the second MFP 121 are connected to each other via a connection unit 136. Thus, a paper discharged from the first MFP 101 can be automatically fed to the second MFP 121.

The paper discharge unit 114 of the printer 112 inside the first MFP 101 is connected to a paper feeding unit 142 of a finisher 109 via a connection unit 141. Thus, a paper discharged from the first MFP 101 can be output directly without passing through the second MFP 121.

If papers printed by the first MFP 101 are stacked on the connection unit 136 successively after each paper is printed, the second MFP 121 must pull out a bottommost paper out of the papers stacked on the connection unit 136 when feeding the paper from among a plurality of the stacked papers. In this case, the feeding of the papers may not be performed smoothly, thereby possibly causing jamming or putting the papers in incorrect order.

Thus, timings for discharging a paper and feeding the paper are controlled by the connection unit 136 as follows. After printing by the printer 112 in the first MFP 101 ends, a paper printed with the color toners is discharged to the paper discharge unit 114 and then carried to the connection unit 136 as it is. Before a next printing by the printer 112 in the first MFP 101 ends and a newly printed paper is discharged to the paper discharge unit 114, the paper placed on the connection unit 136 is fed to the second MFP 121. As a result, a plurality of papers is not stacked on the connection unit 136. In this way, the paper is carried from the first MFP 101 to the second MFP 121.

A personal computer (PC) 138 is connected to the first MFP 101 via a network 137. A driver 139 within the PC 138 recognizes the first MFP 101 and the second MFP 121 as a single printing system using the CMYK color toners and the clear toner, and sends print data to the printing system. This print data includes data necessary for generating intermediate language data, which will be described below, and another data indicating post-processing (such as finishing processing) which should be performed on the intermediate language data after the intermediate language data is printed.

The system illustrated in FIG. 1 can execute the printing with the CMYK color toners and the printing with the clear toner based on a single instruction.

The second MFP 121 can print the clear toner image on the whole surface of the paper. Further, upon a print processing or a copy processing, the second MFP 121 can specify a particular color data and print only the specified portion with the clear toner or partially apply the clear toner on a particular object.

The first MFP 101 using the CMYK color toners will be described in detail. A network interface (I/F) 119 receives print data, and sends raster images and the control data as described below. A controller 102 includes a CPU 103 and an image processing unit 111. An interpreter 104 of the CPU 103 interprets a page description language (PDL) portion of the received print data and generates an intermediate language data (regular) 105. A soft renderer 107 generates a raster image (regular) 110 from the intermediate language data (regular) 105. In the case of a color print job, an image plane exists on the CMYK plane of the raster image (regular). In the case of a monochrome print job, an image plane exists on only the K toner (monochrome toner) face of the raster image (regular). An image processing unit 111 executes image processing to make prints on the raster image (regular) and an image read in by a scanner 116. Its object image is printed by the printer 112.

The printer 112 connected to the controller 102 makes prints on a supplied paper with the CMYK color toners corresponding to data output by the controller 102. The printer 112 includes a paper feeding unit 113 configured to feed a paper to be used for print and the paper discharge unit 114 configured to discharge the paper on which output data is formed. As described above, the paper discharge unit 114 is connected to the paper feeding unit 126 of the MFP 121 via the connection unit 136 and to the paper feeding unit 142 via the connection unit 141. Selection of the connection unit to be used is controlled by the CPU 103. The finisher 109 has functions for sorting, stapling and the like. After processing such as sorting, stapling is performed on a paper fed by the paper feeding unit 142 in the finisher 109, the processed paper is output by a paper discharge unit 143.

There are provided plural discharge trays to which the paper discharge unit 143 discharges papers, which can be switched over depending on a job.

A display device 115 displays a user interface which indicates an instruction to a user and a condition of the first MFP 101. A scanner 116 includes an auto-document feeder. The scanner 116 irradiates one or plural original images with a light source (not illustrated), forms an original reflection image using a lens on a solid-state image sensor such as a charge-coupled device (CCD), and acquires image-read signal in a raster state from the solid-state image sensor as image data. An input unit 117 is an interface configured to receive an input from a user. A storage unit 118 stores data processed by the controller 102. When the MFP 121 prints with the CMYK color toners or K toner (monochrome toner), the first MFP 101 sends the raster image (regular) 110 to the second MFP 121 via the network 120.

When the print data contains an instruction for printing with the clear toner, the interpreter 104 generates the intermediate language data (clear) 106 as well as the intermediate language data (regular) 105. As an example of the data format of the intermediate language data, "a named profile" for giving an instruction to print a specified portion with the clear toner is used. Processing based on this data format will be described below.

When a particular character string is associated with an input color using an application, a named profile corresponding to that character string is selected. Thus, when the particular character string is associated with the clear toner using the driver 139 in the PC 138, a corresponding named profile is selected, so that the clear toner can be selected and specified for a portion which a user wants to print with the clear toner. The interpreter 104 produces the intermediate language data (clear) 106 by extracting only a clear-toner specified portion and creating a layer. Then, a soft renderer 107 converts the intermediate language data (clear) 106 to the raster image (clear) 108. The first MFP 101 sends the raster image (clear) created in the above-described way to the second MFP 121 via the network 120.

Although the named profile has been mentioned above as a method for specifying a portion which a user wants to print with the clear toner, any method may be used as long as the method can create the raster image (clear image) 108 for instructing a print with the clear toner.

The first MFP 101 sends the control data 140 to the second MFP 121 via the network 120. The control data 140 mentioned here refers to information including a number and a size of papers set up by a user via the driver 139, a kind of the media, setting of the finisher and setting of the clear toner.

Next, the second MFP 121 using the clear toner will be described in detail. A network interface 135 is connected to the network interface 119 via the network 120 to send and receive data between the first MFP 101 and the second MFP 121. A controller 122 includes a CPU 123 and an image processing unit 124. A printer 125 connected to the controller 122 is capable of printing a paper with the clear toner and the CMYK color toners. The printer 125 has a paper feeding unit 126 configured to feed a paper and a paper discharge unit 127 configured to discharge a paper on which the output data is formed. The paper feeding unit 126 feeds a paper for use in printing. The paper feeding unit 126 is connected to the paper discharge unit 114 of the first MFP 101 via the connection unit 136 so that a paper discharged from the first MFP 101 can be automatically fed to the paper feeding unit 126. This feeding method has been described above.

A finisher 128 has functions for sorting and stapling of a printed paper. A discharge unit 127 of the printer 125 is connected to a paper feeding unit 129 of the finisher 128 and after performing processing specified by a user such as sorting and stapling of the printed paper, the paper is output by the paper discharge unit 130. There are provided plural paper discharge trays to which the paper discharge unit 130 outputs papers, which may be changed over to each other depending on a job. Description of a display device 131, a scanner 132, an input device 133 and a storage device 134 is omitted because they are similar to those in the first MFP 101.

The second MFP 121 receives any one or both of the raster image (clear) 108 and the raster image (regular) 110 and the control data 140 related therewith. An image processing unit 124 executes processing on any one or both of the raster image (clear image) 108 and the raster image (ordinary) 110 and controls the printer 125 and the finisher 128 based on the control data 140.

According to the data flow described above, any one or both of the raster image (clear) 108 and the raster image (regular) 110 are sent from the first MFP 101 to the controller of the second MFP 121. This is because rendering of the intermediate language data is performed in the first MFP 101. If the controller of the second MFP 121 includes a renderer, it is permissible to send the intermediate language data from the first MFP 101 to the second MFP 121 and generate any one or both of the raster image (clear) 108 and the raster image (regular) 110 in the second MFP 121. In this case, rendering of the intermediate language data to be sent to the second MFP 121 is not performed in the first MFP 101.

In the following description, the rendering of the clear data is performed in the MFP 101. A flow of print processing which the PC 138 executes with the driver 139 in the system of this exemplary embodiment will be described with reference to FIG. 2.

Programs relating to processing from step S201 to step S209, processing from step S213 to step S218, and processing of step S223 are stored in the storage device 118 of the first MFP 101 and called by a RAM (not illustrated) and executed by the CPU 103. A program relating to processing from step S210 to step S212 is stored in a storage device 134 of the second MFP 121 and called by a RAM (not illustrated) and executed by the CPU 123. Processing from step S219 to step S222 and processing from step S224 to step S226 are carried out in the same way.

First, in step S201, the controller 102 acquires print data sent from the PC 138. As described above, when sending the print data, a portion of the print data which a user wants to print with the clear toner is associated with a named profile, so that the PC 138 can give an instruction about printing with the clear toner with respect to a particular color or object. Next, in step S 201, by referring to the named profile or the like in the print data, the CPU 103 determines whether the print data is data which the user instructs to print with the clear toner (hereinafter referred to as clear job)

When the print data is not a clear job, in step S203, the interpreter 104 produces the intermediate language data (regular) 105. Further, in step S204, the soft renderer 107 performs rendering to produce the raster image (regular) 110. Next, in step S205, the CPU 103 determines whether the printer 112 is used for that job. If no clear data is contained in a processing target job, a default printing apparatus set in the printing system is selected.

When it is determined to use the printer 112, in step S206, the image processing unit 111 executes image processing. In step S207, the printer 112 outputs data generated by performing the image processing on the raster image (regular) 110 with the CMYK color toners or the K toner (monochrome toner) onto a paper. Finally, in step S208, a paper discharged by the printer 112 is fed to the finisher 109. Following an instruction by the CPU 103, the finisher 109 executes processing such as sorting and outputs the paper. Further, following an instruction by the CPU 103, the finisher 109 selects a paper discharge tray to which the paper is to be discharged for each job.

On the other hand, in step S205, when it is determined that the printer 112 is not used, the processing proceeds to step S209. In step S209, the CPU 103 sends the control data 140 and the raster image (regular) 110 to the controller 122 of the second MFP 121 via the network interface 119. Next, in step S210, based on the control data 140, the image processing unit 124 of the second MFP 121 executes image processing on the raster image (regular) 110. In step S211, the printer 125 outputs to a paper the data generated by performing the image processing on the raster image (regular) with the CMYK color toners or the K toner (monochrome toner).

Finally, in step S212, a paper discharged by the printer 125 is fed to the finisher 128. Then, following an instruction by the CPU 123 based on the control data 140, the finisher 128 performs processing such as sorting of the printed paper and outputs the printed paper. Further, following an instruction by the CPU 123, the finisher 128 selects a paper discharge tray to which the paper is to be discharged, for each job.

On the other hand, in step S202, when it is determined that the print data contains a clear job including an instruction about printing with the clear toner, the processing proceeds to step S213. Then, the interpreter 104 generates the intermediate language data (regular) 105 and the intermediate language data (clear) 106. In step S214, the soft renderer 107 renders the intermediate language data (regular) 105 to generate the raster image (regular) which serves as a first print data. Further, the soft renderer 107 renders the intermediate language data (clear) 106 to generate the raster image (clear) 108 which serves as a second print data. Next, in step S215, the CPU 103 determines whether the printer 112 is used to print the job. A detail of this determination processing will be described below.

When it is determined that the printer 112 is used, in step S216, the CPU 103 sends the control data 140 and the raster image (clear) 108 to the controller 122 of the second MFP 121 via the network interface 119. Next, in step S217, the image processing unit 111 performs image processing on the raster image (regular) 110. In step S218, the printer 112 outputs to a paper the data generated by performing the image processing on the raster image (regular) with the CMYK color toners or the K toner (monochrome toner). In step S219, by referring to the control data 140, the second MFP 121 feeds a discharged paper printed with the CMYK color toner or the K toner (monochrome toner) via the connection unit 136.

In step S220, the image processing unit 124 performs the image processing for the clear print on the raster image (clear image) based on the control data 140. In step S221, the printer 125 prints the raster image (clear image) on a supplied paper with the clear toner. Finally, in step S222, the paper discharged by the printer 125 is fed to the finisher 128. Then, following an instruction by the CPU 123 based on the control data 140, the finisher 128 performs processing such as sorting of the printed paper and outputs the paper. Further, following an instruction by the CPU 123, the finisher 128 selects a paper discharge tray to which the paper is to be discharged, for each job.

On the other hand, in step S215, when it is determined that the printer 112 is not used, the processing proceeds to step S223. In step S223, the CPU 103 sends the control data 140, the raster image (regular) 110 and the raster image (clear) to the controller 122 of the second MFP 121 via the network interface 119. Next, in step S224, based on the control data 140, the image processing unit 124 of the second MFP 121 executes image processing on the raster image (regular) 110 and the raster image (clear) 108. In step S225, the printer 125 outputs to a paper the data generated by performing the image processing on the raster image (regular) and the raster image (clear) 108 with the CMYK color toners or the K toner (monochrome toner).

Finally, in step S226, a paper discharged by the printer 125 is fed to the finisher 128. Then, following an instruction by the CPU 123 based on the control data 140, the finisher 128 performs processing such as sorting of the printed paper and outputs the paper. Further, following an instruction by the CPU 123, the finisher 128 selects a paper discharge tray to which the paper is to be discharged, for each job.

As a consequence, a variety of jobs can be printed by making effective use of printing capacities of the first MFP 101 and the second MFP 121.

In the meantime, when the print data is sent to the second MFP 121 as the intermediate language data (regular) or the intermediate language data (clear), the processing of step S204 and step S214 is executed by the controller 122 of the second MFP 121.

Figure 2:
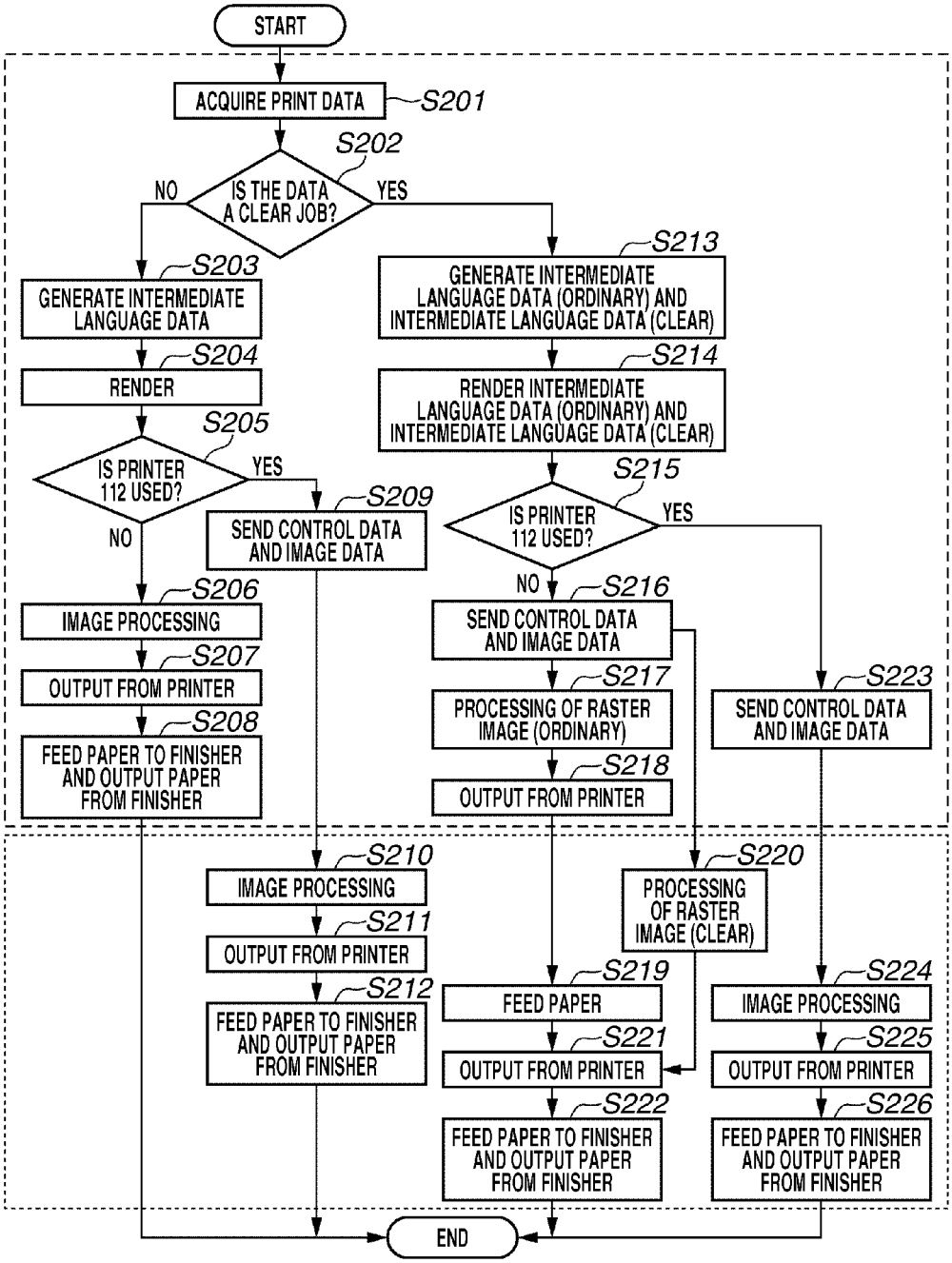
FIG. 2 is a flow chart of a print processing including a clear toner job.

Next, a detail of the determination processing in step S215 in the flow of FIG. 2 will be described with reference to FIG. 3 and following figures.

Figure 3A:
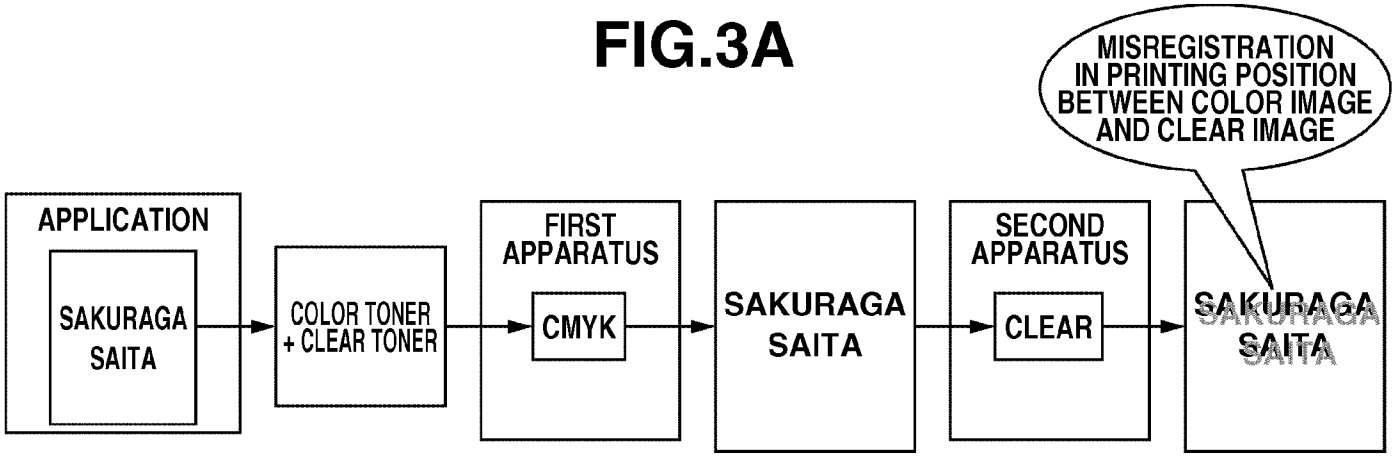
FIG. 3A is a diagram illustrating a flow of copy processing including a clear toner job.

FIG. 3A illustrates a print result generated when the first recording agent (CMYK toner in this case) is applied by the first printing apparatus 101 on the former stage and the second recording agent (clear toner in this case) is applied by the second printing apparatus 121 on the latter stage. Hereinafter, this printing method is defined as 2-pass printing. More specifically, a character portion "SAKURAGASAITA" in a print data produced by an application is instructed to be printed with the color toners. If an instruction is given to print the same character portion with the clear toner, a CMYK image is printed by the first printing apparatus and then, the clear toner image is printed over the CMYK image by the second printing apparatus. Thus, there is a possibility that the color image printed with the color toners and the clear image printed with the clear toner may deviate from each other as illustrated in FIG. 3A.

Figure 3B:
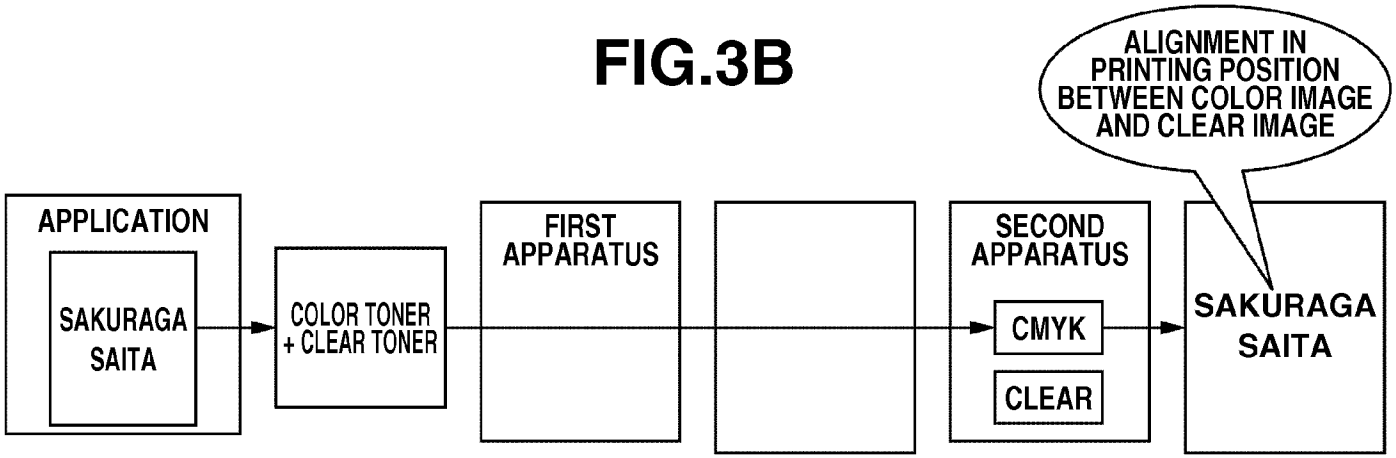
FIG. 3B is a diagram illustrating a difference of the misregistration depending on a printing apparatus which executes a printing procedure.

On the other hand, FIG. 3B illustrates a print result generated when both the first and the second recording agents are applied by the second printing apparatus without carrying out any printing procedure by the first printing apparatus. Hereinafter, this printing method is defined as 1-pass printing. When an instruction is given to print the character portion "SAKURAGASAITA" produced by the same application as FIG. 3A with both the color toners and the clear toner, both the CMYK image and the clear image are printed by the second printing apparatus. Thus, a misregistration similar to FIG. 3 originating from a difference in the printing apparatus is never or hardly generated.

Figure 4A:
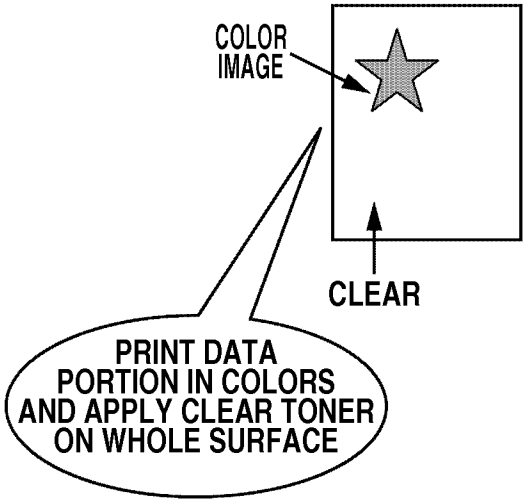
FIGS. 4A, 4B, and 4C are diagrams illustrating a first exemplary embodiment of the present invention.

The image data containing the color data to be printed with the color toners according to an instruction, is printed with the clear toner according to an instruction, and the clear data is added to the color data, in following two ways. In "whole surface clear coating", the clear toner is applied on the surface of the whole printable area of the print paper, and in "partial clear coating", the clear toner is applied on only a particular portion of the printable area. Now, the way of adding the clear data will be considered. When the whole surface clear coating is performed as illustrated in FIG. 4A, a deviation in printing position from the color image portion is not an important problem. On the other hand, when the partial clear coating is performed, if the data is generated placing importance on a relation of a printing position with the color image portion, it is highly possible that the misregistration may become an important problem.

Figure 4B:
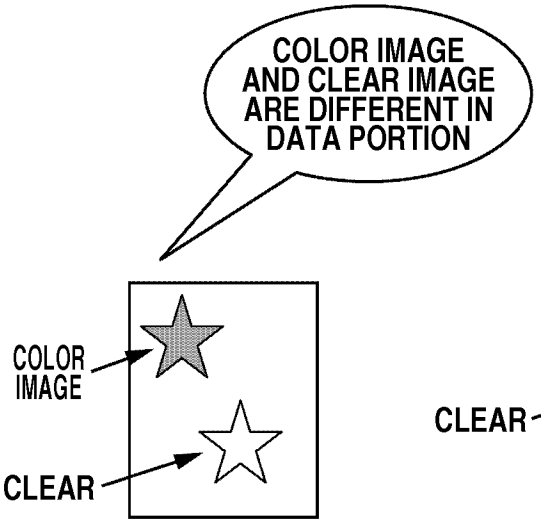
Figure 4C:
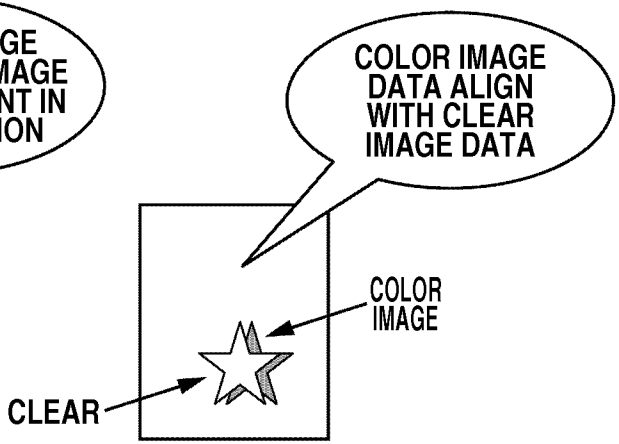

Even when executing the partial clear coating, in the case of data in which the position of an image to be printed with the color toner and the position of an image to be printed with the clear toner are different as illustrated in FIG. 4B, the possibility that the misregistration may become an important problem is low. However, if the position to be printed with the color toner and the position to be printed with the clear toner indicate the same data like FIG. 4C, the possibility that the misregistration may become an important problem is high.

According to this exemplary embodiment, whether the misregistration can be tolerated is determined using a unit which determines the 1-pass printing or the 2-pass printing, based on a way of adding the clear data as above described.

"Not tolerating the misregistration" means "inhibiting occurrence of any misregistration". Hereinafter, a flow of the processing will be described with reference to FIG. 5. A program code for achieving each of the steps of this flow is stored in the storage device 118 and executed by the CPU 103.

Figure 5:
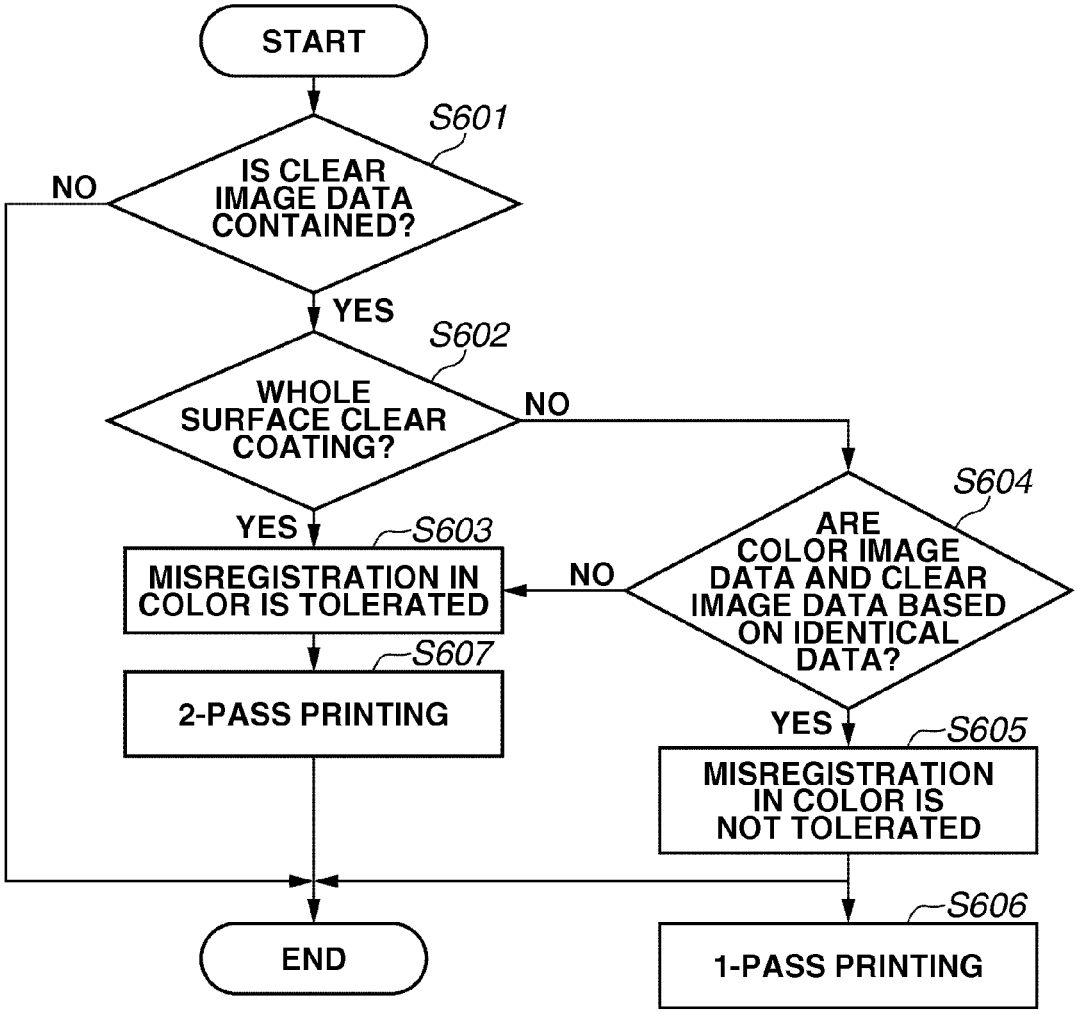
FIG. 5 is a flow chart illustrating the first exemplary embodiment of the present invention.

Referring to FIG. 5, when a print job is created by an application in the PC 138 and the MFP 101 which is the first printing apparatus receives a print job for the printing apparatus through the driver 139, the interpreter 104 operated by the CPU 103 converts that print job to the intermediate language. In step S601, the processing is switched depending on whether the clear data giving an instruction to print with the clear toner is contained in the print data. In step S601, when it is determined that no clear data is contained, the processing moves to default printing in the system (processing by only the first printing apparatus or the second printing apparatus set up in the default printing apparatus of the system).

In step S601, when it is determined that the clear data is contained, the processing proceeds to step S602, in which whether a way of adding the clear toner is "whole surface clear coating" is determined. In step S602, if the whole surface clear coating is specified, the processing proceeds to step S603, and the print job is determined to be a job tolerating the misregistration.

If it is determined that the print job is not performed in the whole surface clear coating but the partial clear coating, in step S602, the processing proceeds to step S604. In step S604, it is determined whether both the color image portion and the clear image portion are specified to be printed at the same position with the respective toners. In step S604, when it is determined that the color image portion and the clear image portion are not specified to be printed at the same position, the print job is determined to be a job which tolerates the misregistration and the processing proceeds to step S603. If, in steps S604, it is determined that the color image portion and the clear image portion are specified to be printed at the same position, the print job is determined to be a job which does not tolerate the misregistration and then, the processing proceeds to step S605.

After the print job passes step S605, in step S606, its print data is printed by only the MFP 121 serving as the latter stage apparatus. In other words, the print data is transferred to and fixed on a paper with the color recording agent and the transparent recording agent by the latter stage apparatus, without use of the former stage apparatus.

In this case, the paper for use in this print may be fed from the paper feeding unit of the printer 112 and carried from the printer 112 to the printer 125 or from a paper feeding unit provided separately in the printer 125.

After the print job passes step S603, its print data is printed by the MFP 101 serving as the former stage apparatus and the MFP 121 serving as the latter stage apparatus. More specifically, the former stage apparatus transfers and fixes the color recording agent to/on the paper and then, the printed paper is carried to the latter stage apparatus, which transfers and fixes the transparent recording agent onto the paper As a result, according to the content of the print data which indicates a way of adding the clear data, a printing apparatus for executing an optimum print processing can be determined.

Here, the conditions of the determination are both whether the whole surface clear coating or the partial clear coating is performed, and whether the position specified to be printed with the color toner and the position specified to be printed with the clear toner are identical. However, these conditions may be determined individually. Additionally, this exemplary embodiment may be implemented not only in a print job but also in a copy job which is fetched from a scanner. Further, while in the above description, the printing system connected to two printing apparatuses is employed, the present exemplary embodiment may be implemented also in one printing apparatus such as the MFP 121 as illustrated in FIG. 9, which can make prints using the color toner and clear toner. If the printing apparatus receives a job including clear data and it is determined that the job "tolerates misregistration" (step S607 of FIG. 5), the color toner is transferred and fixed on a paper sheet, and the discharged sheet is again fed to the printing apparatus. Then, again onto the sheet, the clear toner is transferred and fixed, and the printing process is ended. On the other hand, if it is determined that the job "does not tolerate misregistration" (step S605 of FIG. 5), the color toner and the clear toner are transferred and fixed on a paper sheet at a time, and the printing is ended. In this case, even if MFP 121 does not include a sensor which automatically corrects misregistration, occurrence of misregistration can be suppressed in the job which is determined to tolerate no registration.

Further, in a case where the 2-pass printing is performed, the printing may be performed using the color toner in the second printing apparatus and the printed paper is discharged. Then, the paper is fed again to the second printing apparatus and the printing may be performed using the clear toner. Thus, the above-described exemplary embodiment can be realized with only one printing apparatus without connecting two printing apparatuses.

According to a second exemplary embodiment of the present invention, a method for determining whether the MFP using the color toner is employed or the MFP using the clear toner is employed, is different from the first exemplary embodiment, as described below.

Figure 6A:
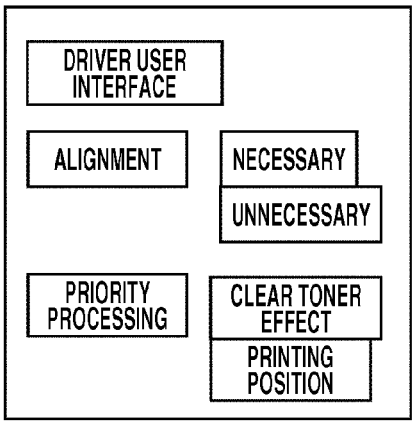
FIGS. 6A, 6B, and 6C are diagrams illustrating a second exemplary embodiment of the present invention.
Figure 6B:
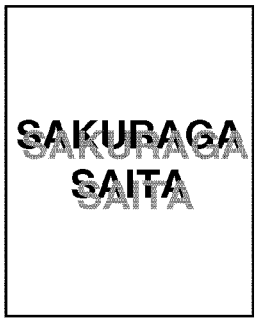
Figure 6C:
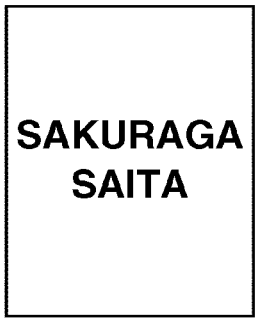

FIGS. 6B and 6C illustrate final outcomes of FIGS. 3A and 3B. FIG. 6A illustrates an example of a user interface (UI) which allows a user to select whether occurrence of the misregistration is tolerated. The UI illustrated in FIG. 6A may be located on the PC 138, or the display device 115 or the input device 117 of the MFP 101 or the MFP 121 in the printing apparatus. When the UI is located on the driver user interface, information indicating whether a menu "alignment" is set to "necessary" or "unnecessary" is embedded into the print job to be sent to the MFP 101. When this information is received, if the alignment is set to "necessary", the interpreter 104 on the controller of the MFP 101 determines that the print data should be processed by the 1-pass printing. If the alignment is set to "unnecessary", the print data should be processed by the 2-pass printing. If the UI is located on the display device or the input device of the printing apparatus, the interpreter performs the above-described determination with reference to setting information received from an input device and held by the storage device 118.

There occurs a difference in printing outcome in addition to the misregistration, between the 1-pass printing and the 2-pass printing. For example, in printing with the color toners, in a case of the 2-pass printing, a sufficient amount of the clear toner can be applied without considering how much of each toner can be loaded on a paper (without considering the loading amount of each toner). Thus, there is an advantage that a printing outcome showing high glossiness can be obtained. Accordingly, when it is determined whether the 1-pass printing or the 2-pass printing is preferable, a determination is made depending on whether the produced clear effect should be emphasized, or an alignment between the portion printed with the clear toner and the portion printed with the color toner should be emphasized. Thus, a menu "priority processing" is prepared on the user interface, thereby enabling a user to select the "clear effect" and "alignment between printed portions" as options. When the "clear effect" is set according to this setting value, the 2-pass printing is selected, and when "alignment between printed portions" is set, the 1-pass printing is selected.

A flow of the processing will be described with reference to FIG. 7. A program code for achieving each step of this flow is stored in the storage device 118 and executed by the CPU 103.

Figure 7:
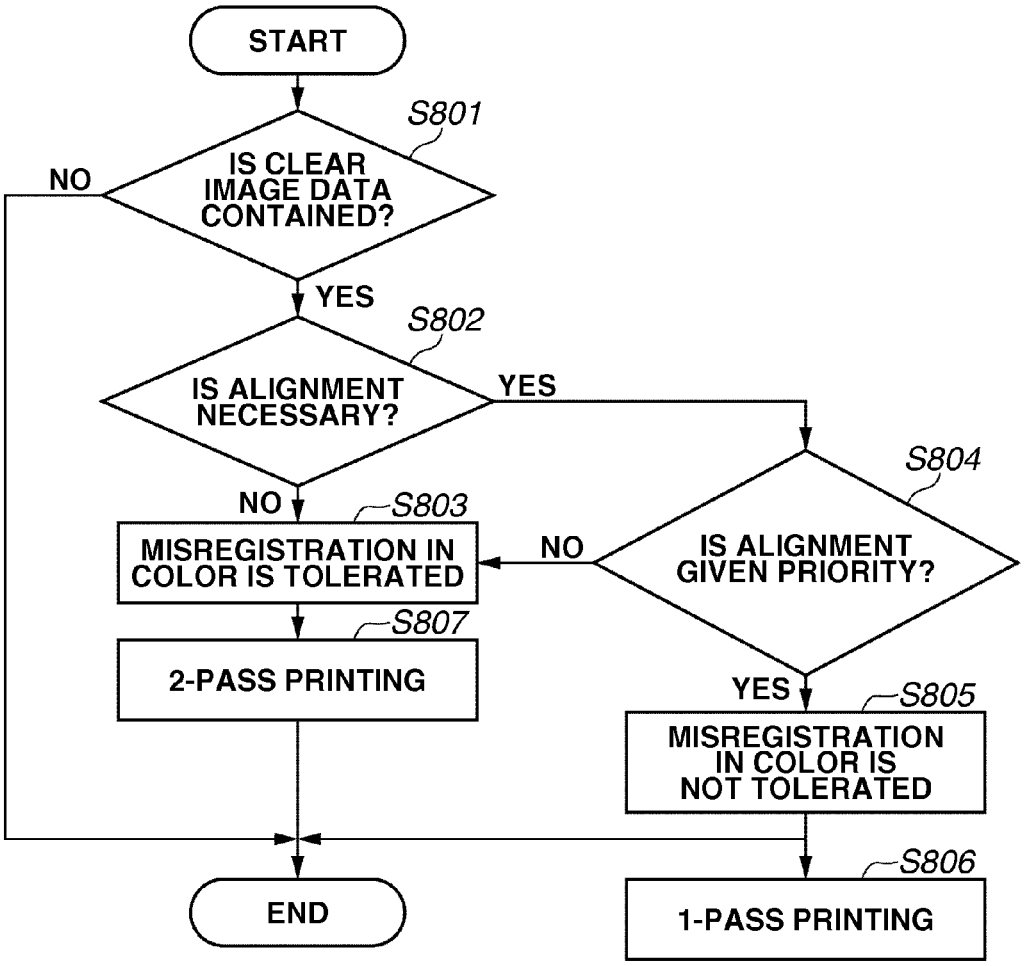
FIG. 7 is a flow chart illustrating the second exemplary embodiment of the present invention.

Referring to FIG. 7, the MFP 101 serving as the first printing apparatus, receives a print job for the printing apparatus through the driver 139, and the interpreter 104 operating on the CPU 103 converts the print job to the intermediate language. At this time, the processing is switched depending on whether the print data contains the clear data. In step S801, when it is determined that no clear data is contained, the processing proceeds to system default printing. In step S801, when it is determined that the clear data is contained, the processing proceeds to step S802, in which whether the menu on the user interface is set to "alignment is necessary" is determined. If, in step S802, the menu is not set to "alignment is necessary", the processing proceeds to step S803, in which the print job is determined to be a job which tolerates the "misregistration".

If, in step S802, the menu is set to "alignment is necessary", the processing proceeds to step S804, in which whether the "priority processing" is set to "alignment under priority" is determined. Unless the menu is set to "priority on alignment", the processing proceeds to step S803, in which the print job is determined to be a job which tolerates "misregistration". If, in step S804, the menu is not set to "priority on alignment" (in this case, "clear effect" is given priority), the processing proceeds to step S805, in which the print job is determined to be a job which does not tolerate the "misregistration".

Based on a result of the determination made here, the print job which tolerates the misregistration moves to step S807, in which the print job is printed by the MFP 101 and the MFP 121. On the other hand, the print job which does not tolerate the misregistration moves to step S806, in which the print job is printed by only the MFP 121.

As a result, a printing apparatus capable of performing an optimum printing processing can be determined by analyzing the setting by a user.

Although the determination condition described in this specification is "alignment" and "priority processing", which are required to be determined at the same time, these conditions may be determined individually. In addition, this exemplary embodiment may be implemented in not only the print job but also the copy job which fetches data from a scanner.

As described in the first exemplary embodiment, the present exemplary embodiment may also be implemented in only one printing apparatus.

OTHER EMBODIMENTS

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable storage medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-290330 filed Dec. 27, 2010, which is hereby incorporated by reference herein in its entirety.

What is claimed is:

1. A printing system including a first printing apparatus using a first recording agent and a second printing apparatus using a second recording agent and the first recording agent in which a paper discharge unit of the first printing apparatus is connected to a paper feeding unit of the second printing apparatus, the printing system comprising:

a determination unit configured to determine whether input image data includes first data to be printed with the first recording agent and second data to be printed with the second recording agent, and whether the input data inhibits misregistration in a printing position between the first data and the second data on the printing paper;

a first printing unit configured to, when the determination unit determines that the input image data inhibits the misregistration in a printing position, print the first data and the second data using the first recording agent and the second recording agent by fixing and transferring the data in the second printing apparatus; and a second printing unit configured to, when the determination unit does not determine that the input image data inhibits misregistration in a printing position, after the first printing apparatus feeds the paper onto which the first data is transferred and fixed with the first recording agent, to the second printing apparatus, transfer and fix again the second data with the second recording agent in the second printing apparatus.

2. The printing system according to claim 1, wherein the data which inhibits the misregistration in a printing position is data in which the position of the first data to be printed with the first recording agent and the position of the second data to be printed with the second recording agent are identical to each other.

3. The printing system according to claim 1, wherein a user specifies whether the print data is data which inhibits the misregistration in a printing position.

4. The printing system according to claim 1, wherein when an effect attained by the second recording agent is given priority, even if the determination unit determines that the print data inhibits the misregistration, the printing is executed by the second printing unit.

5. The printing system according to claim 1, wherein the second recording agent is clear toner.

6. A control method for a printing system including a first printing apparatus using a first recording agent and a second printing apparatus using a second recording agent and the first recording agent, in which a paper discharge unit of the first printing apparatus is connected to a paper feeding unit of the second printing apparatus, the control method comprising:

determining whether an input image data includes first data to be printed with the first recording agent and second data to be printed with the second recording agent, and whether the input data inhibits misregistration in a printing position between the first data and the second data on the printing paper;

first printing in which, when the determination unit determines that the input image data inhibits the misregistration in a printing position, the first data and the second data are printed using the first recording agent and the second recording agent by fixing and transferring the data in the second printing apparatus; and second printing in which, if the determination unit does not determine that the input image data inhibits the misregistration in a printing position, after the first printing apparatus feeds the paper onto which the first data is transferred and fixed with the first recording agent, to the second printing apparatus, the second data is transferred and fixed again using the second recording agent in the second printing apparatus.

7. The control method for a printing system according to claim 6, wherein the data which inhibits the misregistration in a printing position is the data in which the position of the first data to be printed with the first recording agent and the position of the second data to be printed with the second recording agent are identical to each other.

8. The control method for a printing system according to claim 6, wherein a user specifies whether the print data is data which inhibits the misregistration in a printing position.

9. The control method for a printing system according to claim 6, wherein, when the effect by the second recording agent is given priority, even if the determination unit determines that the print data inhibits the misregistration in a printing position, the printing is executed by the second printing.

10. The control method for a printing system according to claim 6, wherein the second recording agent is clear toner.

11. A program configured to cause a computer to execute the control method for the printing system according to claim 6.

12. A printing system comprising:

a determination unit configured to determine whether input image data includes first data to be printed with the first recording agent and second data to be printed with the second recording agent, and whether the input data inhibits misregistration in a printing position between the first data and the second data on the printing paper;

a first printing unit configured to, when the determination unit determines that the input image data inhibits the misregistration in the printing position, transfer and fix the data using the first recording agent and the second recording agent; and a second printing unit configured to, when the determination unit does not determine that the input image data inhibits the misregistration, after transferring and fixing the first data by using the first recording agent, to transfer and fix again the second data by using the second recording agent.

13. A printing method, comprising:

determining whether input image data includes first data to be printed with the first recording agent and second data to be printed with the second recording agent, and whether the input data inhibits misregistration in a printing position between the first data and the second data on the printing paper;

when it is determined that the input image data inhibits the misregistration in a printing position, first printing by fixing and transferring the data using the first recording agent and the second recording agent; and when it is not determined that the input image data inhibits the misregistration in a printing position, after transferring and fixing the first data by using the first recording agent, transferring and fixing again the second data by using the second recording agent.

* * * * *